US005586370A

United States Patent [19]

Fudaki

[11] Patent Number: 5,586,370

[45] Date of Patent: Dec. 24, 1996

[54] SEPARABLE BOTTOM STOP ASSEMBLY FOR SLIDE FASTENER

[75] Inventor: Tsutomu Fudaki, Toyama-ken, Japan

[73] Assignee: YKK Corporation, Tokyo, Japan

[21] Appl. No.: 505,758

[22] Filed: Jul. 21, 1995

[30] Foreign Application Priority Data

Jul. 29, 1994 [JP] Japan ..... 6-178747

[51] Int. Cl.[6] ..... A44B 19/38

[52] U.S. Cl. ..... 24/433; 24/390; 24/381; 24/400

[58] Field of Search ..... 24/390, 381, 433, 24/400

[56] References Cited

U.S. PATENT DOCUMENTS

| | | | |
|---|---|---|---|
| 2,640,255 | 6/1953 | Morrow | 24/433 X |
| 2,649,638 | 8/1953 | Morin | 24/433 X |
| 2,948,039 | 8/1960 | Sim | 24/433 |
| 2,974,382 | 3/1961 | Carlile | 24/433 |
| 4,244,087 | 1/1981 | Akashi | 24/433 |
| 4,326,319 | 4/1982 | Friedberg | 24/433 X |
| 5,388,312 | 2/1995 | Fudaki | 24/433 X |
| 5,412,849 | 5/1995 | Fudaki | 24/433 X |

*Primary Examiner*—Peter R. Brown
*Assistant Examiner*—Stephen Vu
*Attorney, Agent, or Firm*—Hill, Steadman & Simpson

[57] ABSTRACT

A separable bottom stop assembly, for a slide fastener, having a four-member structure composed of a box, a box pin, an separable pin and a stopper. The box has a stopper-insertion hole having on upper and lower surfaces locking grooves engageable with locking ridges of the stopper. A central partition of the box has a locking recess engageable with a locking projection of the box pin. The box pin has a recess for receiving an end of the stopper. Since the stopper engages in the recess while the locking projection engages in the locking recess, the box and box pin can be joined firmly without accidental removal. The box can be attached to the box pin after fastener stringers are sewn to a garment, realizing easy and neat sewing without obstruction by the box.

8 Claims, 8 Drawing Sheets

SEPARABLE BOTTOM STOP ASSEMBLY FOR SLIDE FASTENER

BACKGROUND OF THE INVENTION

1. Field of the Invention

This invention relates to a slide fastener equipped with a separable bottom stop assembly, and more particularly to a separable bottom stop assembly, for a slide fastener, in which when sewing the slide fastener to a garment, a fastener chain is sewn to the garment after a box is removed from the fastener chain, and then the box is threaded on and fixed to a box pin attached to the fastener chain.

2. Description of the Related Art

Japanese Patent Laid-Open Publication No. SHO 58-116391 discloses a slide fastener equipped with a separable bottom stop assembly in which after opposed stringers have been sewn to a garment after both a slider and a box are removed from the stringers, the slider is threaded onto the stringer with a box pin attached thereto, and then the box is threaded onto the box pin and is calked thereto.

Japanese Utility Model Laid-Open Publication No. HEI 6-38622 discloses a concealed slide fastener equipped with a separable bottom stop assembly in which a box pin has on its end a locking projection and has a central groove to facilitate resilient deformation, and a box has in one side wall of a box-pin-insertion hole a locking recess engageable with the locking projection, and in which after a fastener chain has been sewn to a garment, the box is threaded onto the box pin and is fixedly joined thereto.

The conventional means for joining the box and box pin together is exemplified by calking or fusing the box after the box pin is inserted into the box or by inserting a stop pin into the box after the box pin is inserted into the box. Since the box is previously attached to one of the opposed stringers, it is impossible to sew the fastener chain to a garment neatly as the box serves as an obstruction.

In the first-named prior art publication, since the box is calked after threaded onto the box pin, it requires a clenching tool or an exclusive clenching unit, so that the box can not be easily fixed to a fastener stringer after all.

In the last-named prior art publication, since the box pin has on its one end a locking projection and has a central groove to facilitate resilient deformation, adequate locking strength is difficult to achieve. If the box-pin-insertion whole is formed large for inserting the box pin easily, the box pin is loosely and nonstably received in the box so that it is very difficult to reduce the separable bottom stop assembly in size.

SUMMARY OF THE INVENTION

In view of the above-mentioned problems, it is an object of this invention to provide a separable bottom stop assembly, for a slide fastener, in which after opposed stringers of the slide fastener are sewn to a garment after a box is removed from the associated stringer, the box can be attached to the same stringer stably and neatly without difficulty and in which a box pin can be tightly fitted in the box, so the separable bottom stop assembly can be reduced in size.

The above object is accomplished by a separable bottom stop assembly for a slide fastener having a four member structure composed of a box, a box pin, a separable pin, and a stopper as described below. The box has in its one side a stopper-insertion hole communicating with a box-pin-insertion hole. The box pin is adapted to be mounted to a lower end of one of opposed fastener stringers of the slide fastener and inserted in the box-pin-insertion hole, while the separable pin is adapted to be mounted on a lower end of the other stringer of the slide fastener. The stopper is inserted in the stopper-insertion hole to press the box pin against a partition in such a manner that the box, the box pin and the stopper are fixedly joined together.

Preferably, the box pin has a recess facing the stopper-insertion hole to engage the stopper when the stopper is inserted through the stopper-insertion hole, so that the box and the box pin can fixedly engage with each other.

Further, the box has in one side wall of the box-pin-insertion hole a locking recess, and the box pin has a locking projection engageable with the locking recess. The locking recess in one side wall of the box-pin-insertion hole is within the range of alignment with the stopper-insertion hole in a stopper inserting direction.

The stopper has a pressure projection extending from a front inner edge of the stopper for pressing the box pin against the wall of the box-pin-insertion hole to firmly join the box and the box pin together.

Furthermore, the stopper has on its opposite side surfaces removal-prevention locking ridges, and the box has in opposite side walls of the stopper-insertion hole serrated locking grooves engageable with the locking ridges.

For the separable bottom stop assembly of the ordinary type slide fastener, the box has in its opposite side surfaces a pair of vertical slits for inserting of the opposite stringers. For the separable bottom stop assembly of the concealed type slide fastener, the box has in its front surface a vertical opening facing the partition for inserting the opposed stringers.

In production, the stringer on which the box pin is mounted and the stringer on which the separable pin is mounted are sewn to a garment along the respective sewing lines near to the coupling element rows, and the slider is threaded onto the box-pin-carrying stringer from the box pin side, whereupon the box is fixedly secured to the box pin using the stopper to complete the separable bottom stop assembly. Alternatively, the slider may be threaded onto the box-pin-carrying stringer before the stringer is sewn to the garment; the slider may be moved away from the sewing stringer portion so as not to obstruct the sewing.

After completion of this separable bottom stop assembly, it does not require a special operation but only require an opening and closing operation of the separable slide fastener likewise the ordinary separable bottom stop assembly.

DETAILED DESCRIPTION OF THE PREFERRED EMBODIMENTS

Figure 1:
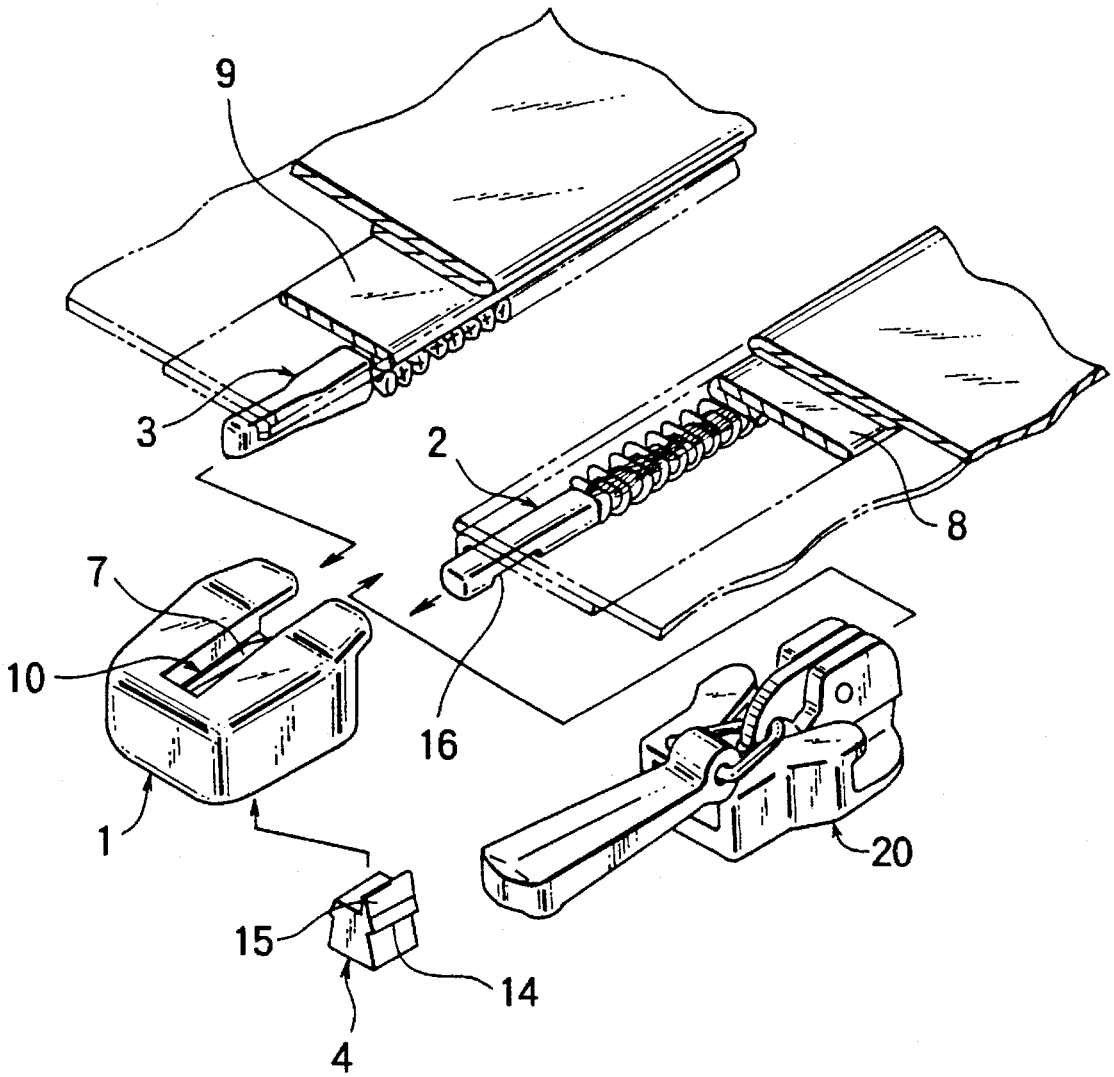
FIG. 1 is an exploded perspective view of a separable bottom stop assembly, for a slide fastener, according to a first embodiment of this invention.

Various preferred embodiments of a separable bottom stop assembly, for a slide fastener, according to this invention will now be described in detail with reference to the accompanying drawings.

The separable bottom stop assembly of this invention may be used in a concealed slide fastener, for example, as shown in FIGS. 1 through 4. The separable bottom stop assembly of the concealed type slide fastener has a four-member structure composed of a box 1, a box pin 2, a separable pin 3 and a stopper 4. The box 1 has a box-pin-insertion hole 5 in which the box pin 2 is to be inserted and a separable-pin-insertion hole 6 in which the separable pin 3 is to be inserted. These two holes 5, 6 may be either bottomless or blind.

Figure 2:
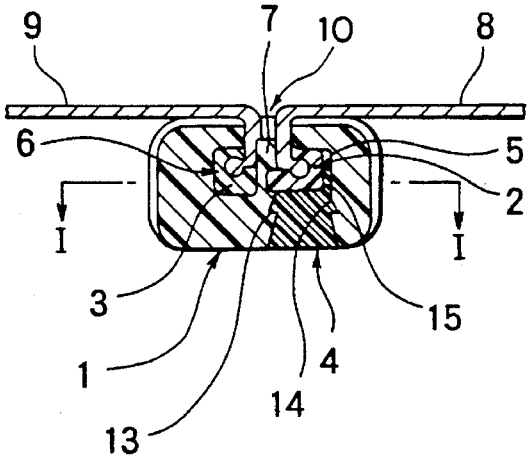
FIG. 2 is a transverse cross-sectional view of the separable bottom stop assembly (taken along line II—II of FIG. 3)
Figure 3:
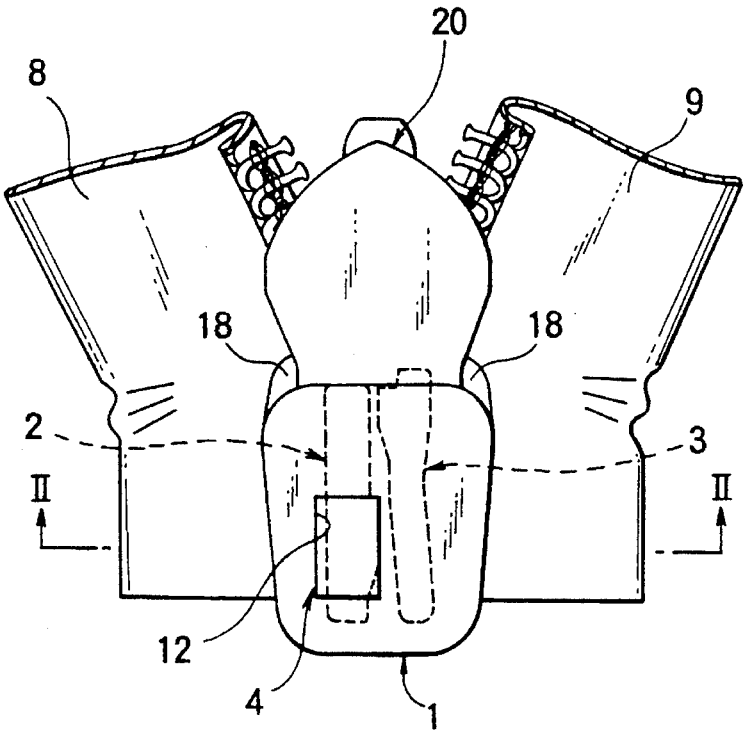
FIG. 3 is a rear plan view showing the separable bottom stop assembly in use.
Figure 4:
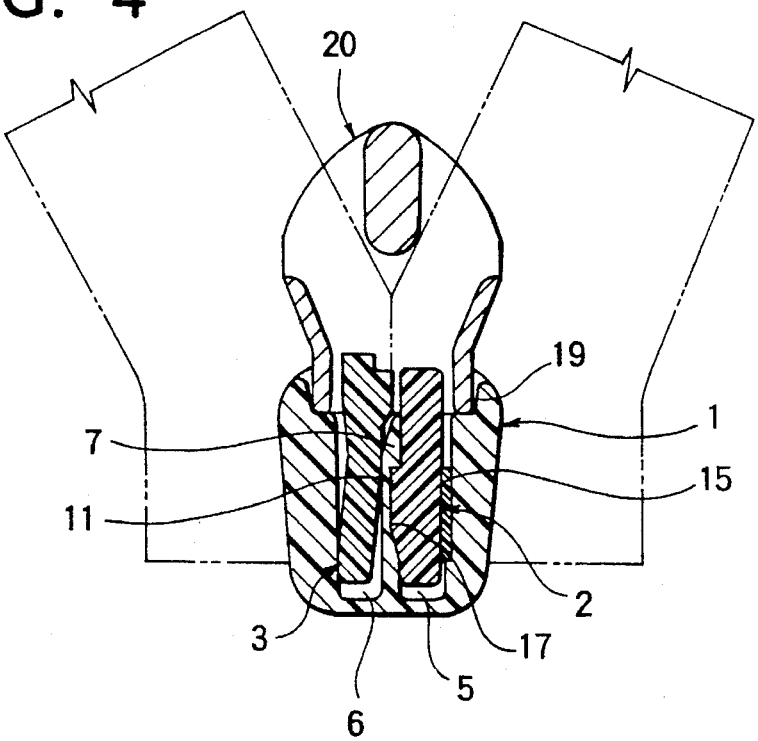
FIG. 4 is a longitudinal cross-sectional view taken along line I—I of FIG. 2.

The two holes 5, 6 are separated by a partition 7, and the box 1 has on its front side a vertical opening 10 facing the partition 7 in which opposed stringers 8, 9 of the slide fastener can be inserted as shown in FIG. 2. The partition 7 has on its one side surface toward the box-pin-insertion-hole 5 and partly defining the box-pin-insertion hole 5 a locking recess 11 that is engageable with the box pin 2 as shown in FIG. 4.

The box 1 has on its rear side a stopper-insertion hole 12 which is rectangular in cross section and communicating with the box-pin-insertion hole 5. The stopper-insertion hole 12 has on opposite side surfaces serrated locking grooves 13 as shown in FIG. 2 so that the stopper 4 is prevented from being removed after insertion. The locking recess 11 is located within the range of the stopper-insertion hole 12 as viewed in the direction perpendicular to the general plane of the slide fastener.

The stopper 4 is in the form of a trapezoidal block having on opposite slant surfaces serrated locking ridges 14 that are engageable with the locking grooves 13 of the stopper-insertion hole 12. The front end of the stopper 4 is projectable into the box-pin-insertion hole 5 and has a pressure projection 15 extending from its edge for pressing the inserted box pin 2 against the partition 7.

On the other hand, the box pin 2 has a recess 16 confronting the stopper-insertion hole 12 of the box 1 when the box pin 2 is inserted into the box-pin-insertion hole 5. The box pin 2 also has a locking projection 17 confronting and engageable with the locking recess 11 of the partition 7, as shown in FIG. 4.

The box 1 has an extension 18 on its upper front portion and a cutaway 19 in the peripheral wall of the other upper portions so that a slider 20 can rest on the top of the box 1 easily and stably when the slider 20 is pulled all the way down to the box 1. Preferably the separable bottom stop assembly is made of synthetic resin, such as polyamide, polypropylene or polyacetal, by injection molding. Alternatively, it may be made of metal or combination of resin and metal.

For assembly and use of this separable bottom stop assembly, the box pin 2 is attached to the lower end of one stringer 8, and the separable pin 3 is attached to the lower end of the other stringer 9. The resulting stringers 8, 9 are sewn to the confronting edges of a garment as shown in FIG. 1, and the slider 20 is threaded onto the box-pin carrying stringer 8 through the box pin 2, whereupon the stringer 8 is inserted through the opening 10 with inserting the box pin 2 into the box-pin-insertion hole 5 of the box 1 as shown FIG. 2.

Then, as the stopper 4 is inserted from the stopper-insertion hole 12 until the front end of the stopper 4 is received in the recess 16 of the box pin 2, and the pressure projection 15 is fitted between the box pin 2 and the wall surface of the box-pin-insertion hole 5 to press the box pin 2 against the partition 7 and to bring the locking projection 17 of the box pin 2 to engage in the locking recess 11 of the partition 7 as shown in FIG. 4. At that time, the box 1 and the box pin 2 are firmly joined together as the locking ridges 14 of the stopper 4 engage in the locking grooves 13 of the stopper-insertion hole 12 as shown in FIG. 2. Upon completion of assembling of the separable bottom stop assembly, the fastener chain can be attached to a garment for use.

Figure 5:
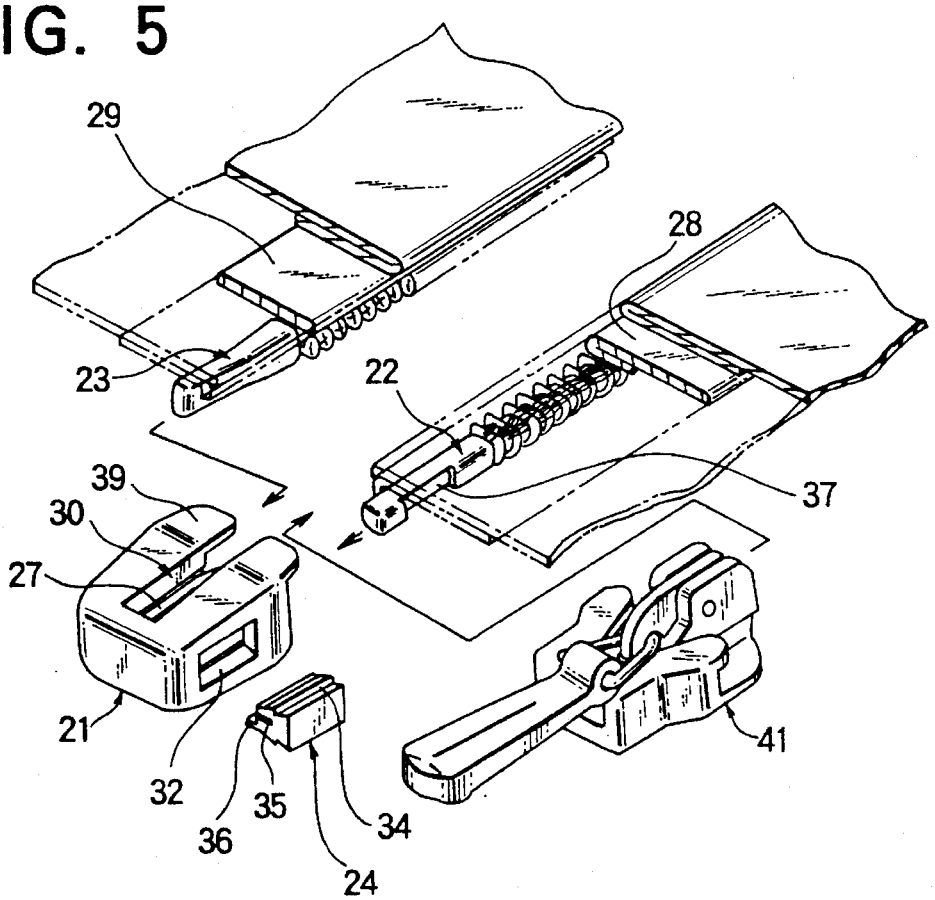
FIG. 5 is an exploded perspective view similar to FIG. 1, showing a separable bottom stop assembly according to a second embodiment.
Figure 6:
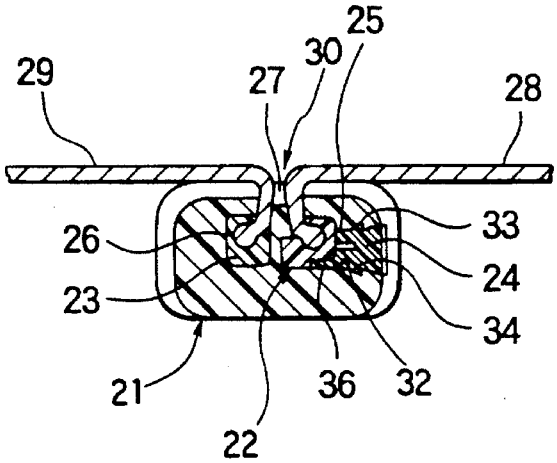
FIG. 6 is a transverse cross-sectional view of the separable bottom stop assembly of FIG. 5.
Figure 7:
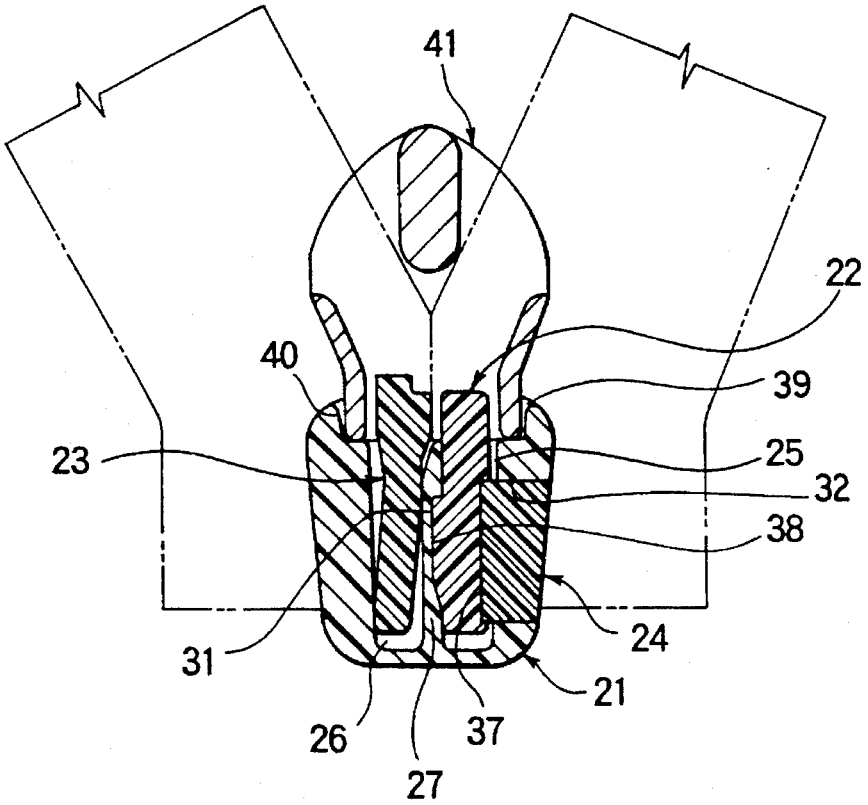
FIG. 7 is a longitudinal cross-sectional view of the separable bottom stop assembly of FIG. 5.

FIGS. 5 through 7 show a separable bottom stop assembly, for a concealed slide fastener, according to a second embodiment which also has a four-member structure composed of a box 21, a box pin 22, a separable pin 23 and a stopper 24. The separable bottom stop assembly of the second embodiment is different from the first embodiment in how to insert the stopper 24 into the box 21 from its side surface. Specifically, the box 21 has a box-pin-insertion hole 25 in which the box pin 22 is to be inserted and a separable-pin-insertion hole 26 in which the separable pin 23 is to be inserted as shown in FIG. 6. These two holes 25, 26 extend parallel to each other and are separated by a central partition 27. The box 21 has on its front side a vertical opening 30 facing the partition 27 for insertion of opposed stringers 28, 29 of the concealed slide fastener. The partition 27 has on one side surface partly defining the box-pin-insertion hole 25 a locking recess 31 that is laterally aligned with a stopper-insertion hole 32 (described below) as shown in FIG. 7 for engagement with the box pin 22.

The stopper-insertion hole 32 of the box 21 has a rectangular cross section and communicates with the box-pin-insertion hole 25, having on upper and lower surfaces (FIG. 6) serrated locking grooves 33 so that the stopper 24 is prevented from being removed after insertion.

The stopper 24 is in the form of a trapezoidal block having on its upper and lower slant surfaces serrated locking ridges 34 engageable with the locking grooves 33 of the stopper-insertion hole 32, as shown in FIG. 6. The stopper 24 also has in its end a central groove 35 for resilient deformation. And the stopper 24 has on its lower edge a pressure projection 36 for pressing the inserted box pin 22 toward the vertical opening 30.

On the other hand, box pin 22 has a recess 37 facing the stopper-insertion hole 32 of the box 21 and has on one surface a locking projection 38 engageable with the locking recess 31 of the partition 27, as shown in FIG. 7. The box 21 has an extension 39 on its upper front portion and a cutaway 40 in the peripheral wall of the other upper portions so that a slider 41 can rest on the top of the box 21 easily and stably when the slider 41 is pulled all the way down to the box 21. This separable bottom stop assembly may be assembled in the same way as in the first embodiment.

Figure 8:
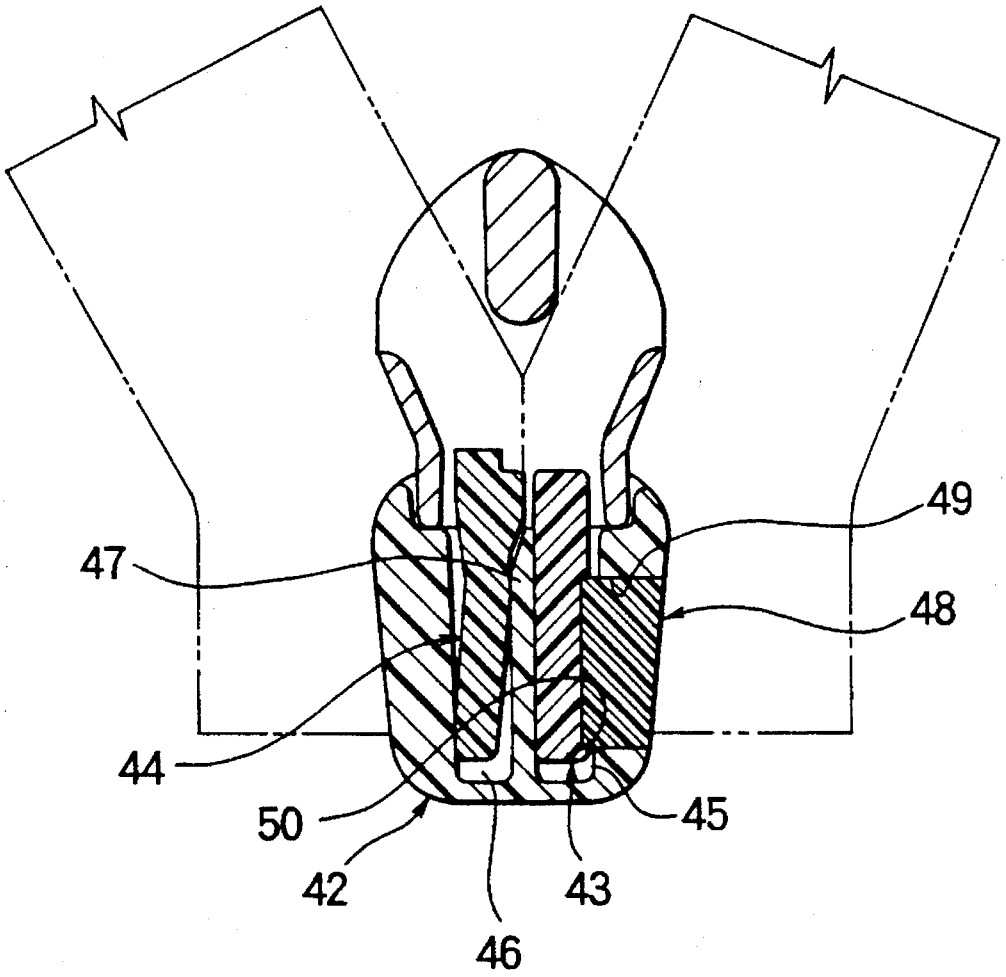
FIG. 8 is a longitudinal cross-sectional view similar to FIG. 7, showing a separable bottom stop assembly according to a third embodiment.

FIG. 8 shows a separable bottom stop assembly according to a third embodiment, in which a box 42 has a box-pin-insertion hole 45 in which a box pin 43 is to be inserted and a separable-pin-insertion hole 46 in which a separable pin 44 is to be inserted. These two holes 45, 46 extend parallel to each other and are separated by a central partition 47. The box 42 also has a stopper-insertion hole 49 through which a stopper 48 is to be inserted to press the inserted box pin 43 against the partition 47. The partition 47 has no locking recess engageable with the box pin 43, which does not have any locking projection but a recess 50 engageable with the stopper 48 when the latter is inserted through the stopper-insertion hole 49, facilitating pushing the box pin 43 by the stopper 48, thus making a stable engagement between the box 42 and the box pin 43.

Figure 9:
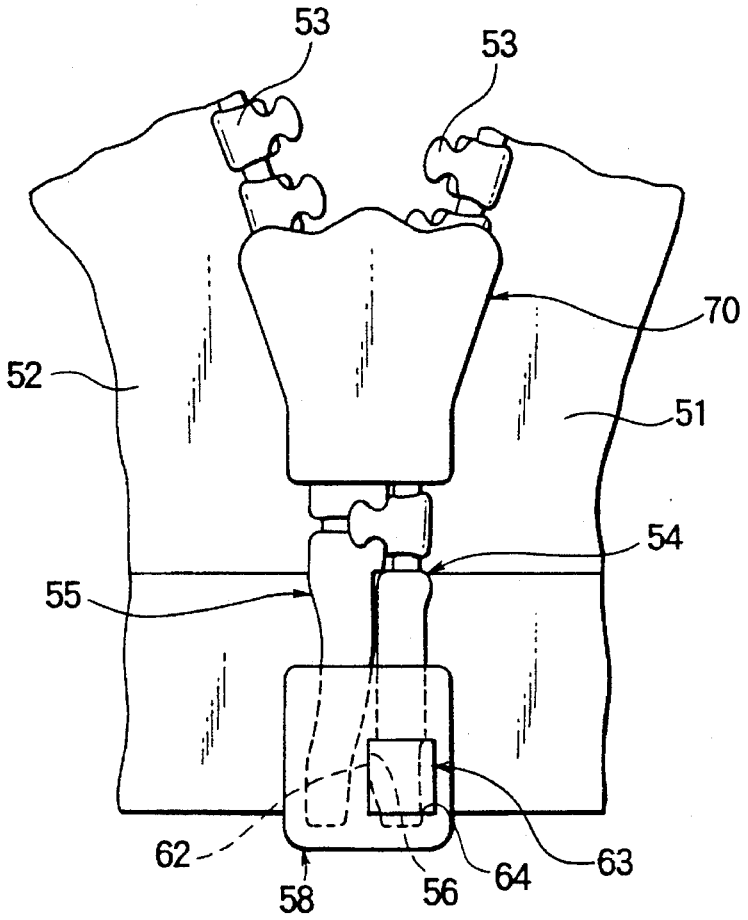
FIG. 9 is a rear plan view of a separable bottom stop assembly in use according to a fourth embodiment, showing the separable bottom stop assembly in use.
Figure 10:
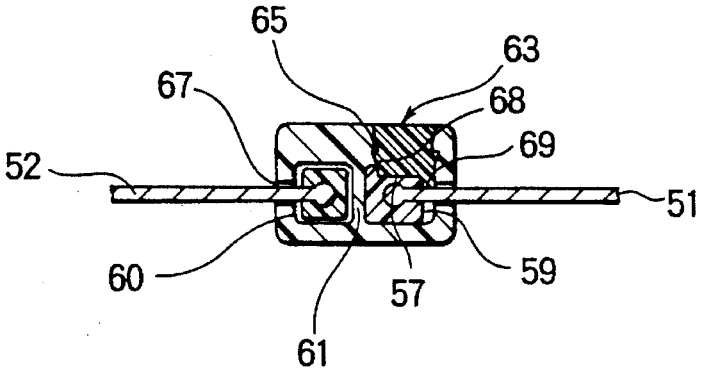
FIG. 10 is a transverse cross-sectional view of the separable bottom stop assembly of FIG. 9.

FIGS. 9 and 10 show a separable bottom stop assembly, for the ordinary type slide fastener, according to a fourth embodiment. In the illustrated slide fastener, coupling elements 53 of synthetic resin, such as polyamide, polypropylene or polyacetal, are injection-molded on opposed fastener tapes. In the separable bottom stop assembly of this slide fastener, a box pin 54 and a separable pin 55 are mounted on opposite fastener stringers 51, 52 by injection molding simultaneously with the injection molding of the coupling elements 53. At that time, a locking projection 56 is formed on the inner surface of the box pin 54, and a recess 57 is formed on the rear surface of the end of the box pin 54 for a purpose described below.

On the other hand, the box 58 has a box-pin-insertion hole 59 in which the box pin 54 is to be inserted and a separable-pin-insertion hole 60 in which the separable pin 55 is to be inserted. These two holes 59, 60 are separated by a central partition 61. The partition 61 has in one side surface partly defining the box-pin-insertion hole 59 a locking recess 62 engageable with the locking projection 56 of the box pin 54. The box 58 has on its rear side a stopper-insertion hole 64 through which a stopper 63 having a rectangular cross section is to be inserted. The partition 61 has a locking recess 62 matching with the stopper-insertion hole 64 of the box 58. The stopper-insertion hole 64 has on opposite side surfaces serrated locking grooves 65 as shown in FIG. 10. Also the box 58 has centrally on opposite sides a pair of vertical slits 66, 67 for insertion of the opposed stringers 51, 52, respectively.

The stopper 63 is in the form of a trapezoidal block having on its opposite slant surfaces serrated locking ridges 68 engageable with the locking grooves 65 of the stopper-insertion hole 64, as shown in FIG. 10. The front end surface of the stopper 63 comes into engagement with the recess 57 of the box pin 54. The stopper 63 has on its outer edge a pressure projection 69 for pressing the inserted box pin 54 against the partition 61. This separable bottom stop assembly may be assembled in the same way as in the foregoing embodiments.

In FIG. 9, reference numeral 70 designates a slider, which may be threaded on the stringer 51 before the stringer 51 is sewn to a garment or may be threaded on the stringer 51 after the box 58 is secured to the box pin 54 after sewing the stringer 51 to the garment.

Figure 11:
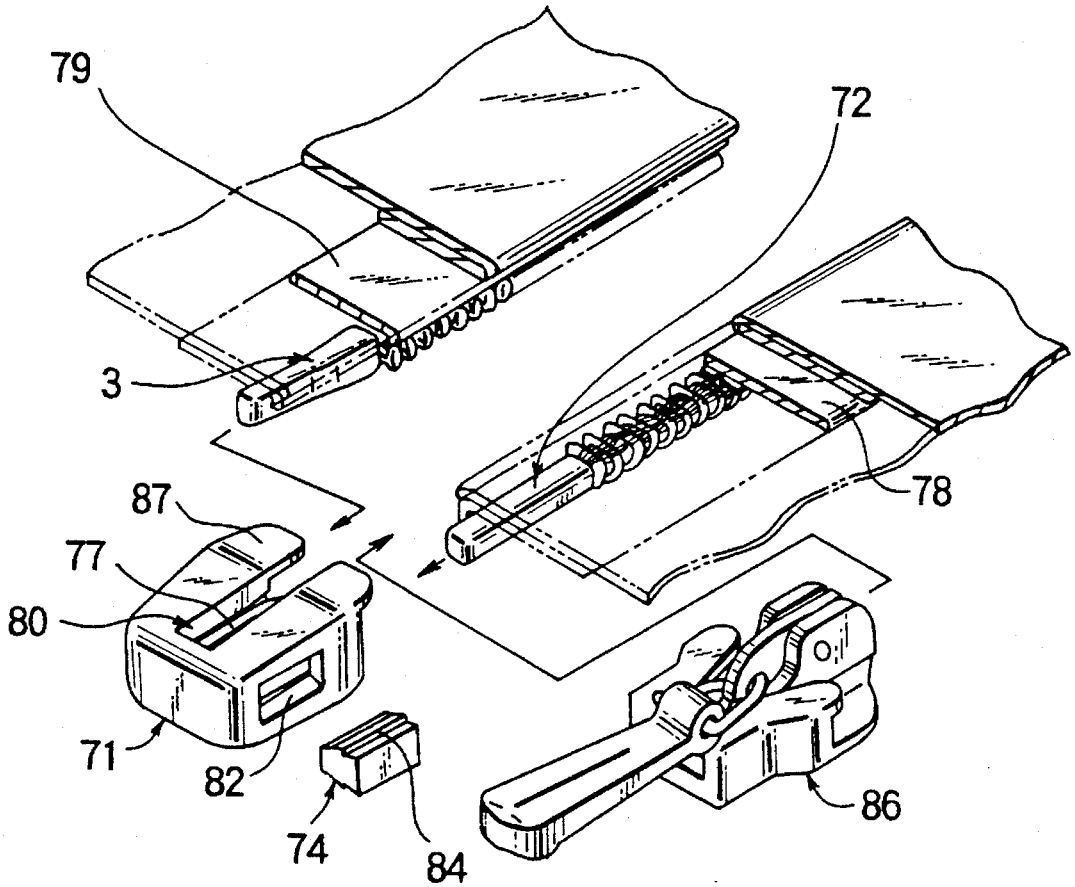
FIG. 11 is an exploded perspective view similar to FIG. 5, showing a separable bottom stop assembly according to a fifth embodiment.
Figure 12:
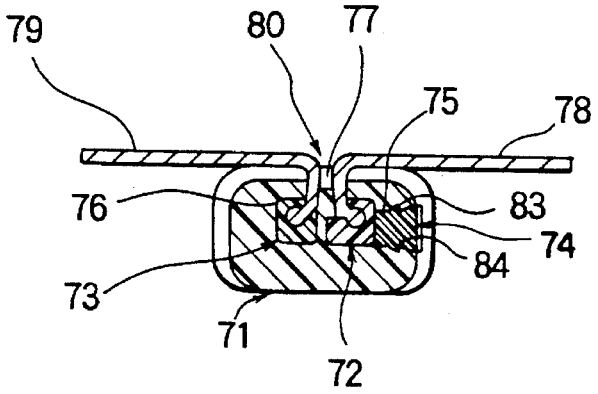
FIG. 12 is a transverse cross-sectional view of the separable bottom stop assembly of FIG. 11.
Figure 13:
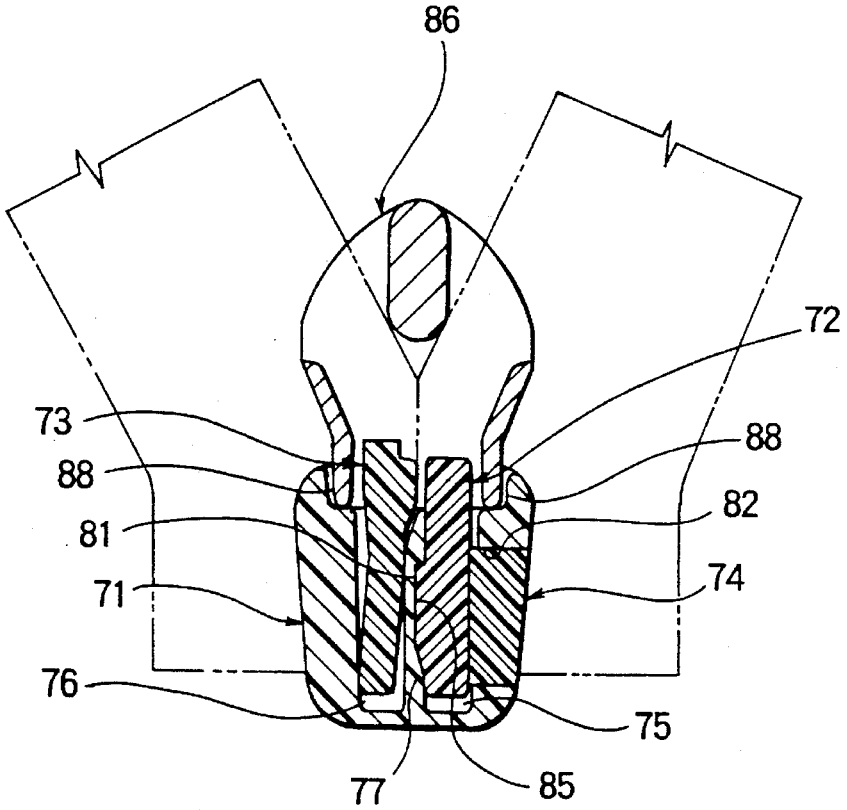
FIG. 13 is a longitudinal cross-sectional view of the separable bottom stop assembly of FIG. 11.

FIGS. 11 through 13 show a separable bottom stop assembly, for a concealed slide fastener, according to a fifth embodiment which is a four-member structure composed of a box 71, a box pin 72, a separable pin 73 and a stopper 74. The box 71 has a box-pin-insertion hole 75 and a separable-pin-insertion hole 76 which extend parallel to each other and are separated by a central partition 77 as shown in FIG. 12. The two holes 75, 76 may be either blind or bottomless. The box 71 has on its front side a vertical opening 80 through which opposed stringers 78, 79 of the concealed slide fastener are to be inserted. The partition 77 has in one side surface partly defining the box-pin-insertion hole 75 a locking recess 81 engageable with the box pin 72 as shown in FIG. 13.

The box 71 has on one side a rectangular stopper-insertion hole 82 through which the stopper 74 is to be inserted to press the inserted box pin 72 against the partition 77. The stopper-insertion hole 82 has in its upper and lower surfaces serrated locking grooves 83 for preventing the stopper 74 from being removed when inserted through the stopper-insertion hole 82. The locking recess 81 of the partition 77 is laterally aligned with the stopper-insertion hole 82 of the box 71.

The stopper 74 is in the form of a trapezoidal block having on upper and lower slant surfaces serrated locking ridges 84 engageable with the locking grooves 83 of the stopper-insertion hole 82. The front end surface of the stopper 74 is flat so that the stopper 74 can push the inserted box pin 72 against the partition 77 when the stopper 74 is inserted through the stopper-insertion hole 82. On the other hand, the box pin 72 has on one surface a locking projection 85 engageable with the locking recess 81 of the partition 77, as shown in FIG. 13.

The separable bottom stop assembly of the fifth embodiment is different from the foregoing embodiments in that the box pin 72 has no recess engageable with the stopper 74 and that when the box pin 72 is pressed against the partition 77 by the stopper 74, the locking projection 85 of the box pin 72 comes into engagement with the locking recess 81 of the partition 77 to firmly secure the box 71 to the box pin 72. Reference numerals 86, 87, 88 designate a slider, an extension and a cutout, respectively. This separable bottom stop assembly may be assembled in the same way as the foregoing embodiments.

As is apparent from the foregoing description, the separable bottom stop assembly of this invention has the following results:

Since the box has on one side a stopper-insertion hole communicating with the box-pin-insertion hole so that the stopper can be inserted through the stopper-insertion hole to press the inserted box pin against the partition of the box, it is possible to secure the box to the box pin easily after the box pin is sewn to a garment. During this sewing, the box-pin-carrying stringer can be sewn along a sewing line near to the coupling element row easily and neatly without being obstructed by the box. It is also possible to assemble the separable bottom stop assemble in a very simple way without using a special tool.

Further, since the box pin has a recess in alignment with the stopper-insertion hole to receive the end of the stopper when the stopper is inserted through the stopper-insertion hole, it is possible to join the box and the box pin together firmly in a proper posture, thus realizing a compact separable bottom stop assembly that is easy to assemble.

Furthermore, since the box pin has a locking projection engageable with a locking recess formed in one side wall of the box-pin-insertion hole, it is possible to join the box and the box pin together more reliably and firmly. Since it is located in alignment with the stopper-insertion hole, the locking recess can be formed with maximum ease.

Additionally, since the stopper has on its front edge a pressure projection for pressing the box pin against one wall of the box-pin-insertion hole, the box pin can be connected to the box stably with no shake. Also since the stopper has on opposite surfaces locking ridges engageable with locking grooves formed in the corresponding walls of the stopper-insertion hole, it is possible to prevent the stopper from being removed from the stopper-insertion hole.

The separable bottom stop assembly of this invention can be used not only in the ordinary type slide fastener but also in the concealed type slide fastener and is hence particularly useful.

What is claimed is:

1. A separable bottom stop assembly for a slide fastener, comprising:

(a) a box having on one side thereof a stopper-insertion hole communicating with a box-pin-insertion hole;

(b) a box pin adapted to be mounted to a lower end of one fastener stringer of a pair of fastener stringers of the slide fastener and inserted in said box-pin-insertion hole;

(c) a separable pin adapted to be mounted on a lower end of a second fastener stringer of the pair of fastener stringers of the slide fastener; and (d) a stopper from said box and said box pin inserted in said stopper-insertion hole to press said box pin against a partition of said box in such a manner that said box, said box pin and said stopper are fixedly joined together.

2. A separable bottom stop assembly according to claim 1, wherein said box pin has a recess facing said stopper-insertion hole to engage said stopper.

3. A separable bottom stop assembly according to claim 1, wherein said box has on a side wall of said box-pin-insertion hole a locking recess, and said box pin has a locking projection engageable with said locking recess.

4. A separable bottom stop assembly according to claim 1, wherein said locking recess on one side wall of said box-pin-insertion hole is alignment with said stopper-insertion hole in a stopper-inserting direction.

5. A separable bottom stop assembly for a slide fastener, comprising:

(a) a box having on one side thereof a stopper-insertion hole communicating with a box-pin-insertion (b) a box pin adapted to be mounted to a lower end of one fastener stringer of a pair of fastener stringers of the slide fastener and inserted in said box-pin-insertion hole;

(c) a separable pin adapted to be mounted on a lower end of a second fastener stringer of the pair of fastener stringers of the slide fastener;

(d) a stopper inserted in said stopper-insertion hole to press said box pin against a partition of said box in such a manner that said box said box pin and said stopper are fixedly joined together; and wherein said stopper has a pressure projection extending from a front inner edge of said stopper.

6. A separable bottom stop assembly for a slide fastener, comprising:

(a) a box having on one side thereof a stopper-insertion hole communicating with a box-pin-insertion hole;

(b) a box pin adapted to be mounted to a lower end of one fastener stringer of a pair of fastener stringers of the slide fastener and inserted in said box-pin-insertion hole;

(c) a separable pin adapted to be mounted on a lower end of a second fastener stringer of the pair of fastener stringers of the slide fastener;

(d) a separate stopper inserted in said stopper-insertion hole to press said box pin against a partition of said box in such a manner that said box, said box pin and said stopper are fixedly joined together; and wherein said stopper has on opposite side surfaces thereof locking ridges for removal-prevention, and said box has on opposite side walls of said stopper-insertion hole locking grooves engageable with said locking ridges.

7. A separable bottom stop assembly according to claim 1, wherein said box has on opposite side surfaces thereof a pair of vertical slits for inserting the pair of stringers.

8. A separable bottom stop assembly according to claim 1 wherein said box has in a front surface thereof an opening facing said partition for inserting the pair of stringers.

* * * * *